US011174856B2

(12) United States Patent
Robison et al.

(10) Patent No.: US 11,174,856 B2
(45) Date of Patent: Nov. 16, 2021

(54) APPARATUS AND METHODS FOR COUNTERBALANCING A PUMPING UNIT

(71) Applicant: Weatherford Technology Holdings, LLC, Houston, TX (US)

(72) Inventors: Clark E. Robison, Tomball, TX (US); Jeffrey John Lembcke, Cypress, TX (US); Ross E. Moffett, Kingwood, TX (US); Bryan A. Paulet, Spring, TX (US); Phillip Andrew Briggs, Kingwood, TX (US); Brent Wesley Pickens, Oklahoma City, OK (US); Benson Thomas, Pearland, TX (US); Robert McDonald, Conroe, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 234 days.

(21) Appl. No.: 15/345,288

(22) Filed: Nov. 7, 2016

(65) Prior Publication Data

US 2018/0128264 A1 May 10, 2018

(51) Int. Cl.

| | |
|---|---|
| ***F04B 47/14*** | (2006.01) |
| ***F04B 47/02*** | (2006.01) |
| ***E21B 43/12*** | (2006.01) |

(52) U.S. Cl.

CPC ..... *F04B 47/14* (2013.01); *E21B 43/127* (2013.01); *F04B 47/028* (2013.01)

(58) Field of Classification Search

CPC ..... F04B 47/14; F04B 47/028; F04B 47/026; F04B 51/00; E21B 43/127; E21B 47/008; E21B 2043/124

USPC ..... 417/53

See application file for complete search history.

(56) References Cited

U.S. PATENT DOCUMENTS

| | | | | |
|---|---|---|---|---|
| 2,739,493 | A * | 3/1956 | Eaton | F04B 47/14 74/591 |
| 3,130,601 | A * | 4/1964 | Gallaway | G01M 1/30 74/590 |
| 4,479,564 | A * | 10/1984 | Tanguy | E21B 44/00 175/45 |
| 4,505,162 | A * | 3/1985 | Hoh | F04B 47/028 74/108 |
| 4,603,592 | A | 8/1986 | Siebold et al. | |

(Continued)

FOREIGN PATENT DOCUMENTS

| | | | |
|---|---|---|---|
| CN | 203535446 U | * | 4/2014 |
| CN | 203535446 U | | 4/2014 |

OTHER PUBLICATIONS

English Translation of CN 203535446 obtained Nov. 14, 2018 (Year: 2018).*

(Continued)

*Primary Examiner* — Connor J Tremarche

(74) *Attorney, Agent, or Firm* — Patterson + Sheridan, LLP

(57) ABSTRACT

Embodiments of the present disclosure generally relate to apparatus and methods for counterbalancing a pumping unit. One embodiment of the present disclosure provides a method for operation a pumping unit. The method includes measuring an orientation of a component and one or more parameters of the pumping unit while running the pumping unit, and determining an imbalance of the pumping unit according to the measured orientation and one or more parameters.

16 Claims, 9 Drawing Sheets

(56) References Cited

U.S. PATENT DOCUMENTS

| | | | | |
|---|---|---|---|---|
| 4,631,954 | A * | 12/1986 | Mills | F04B 47/028 166/250.15 |
| 4,660,426 | A | 4/1987 | Mosley | |
| 5,063,775 | A * | 11/1991 | Walker, Sr. | E21B 47/0008 73/152.31 |
| 2005/0238496 | A1* | 10/2005 | Mills | E21B 47/0007 417/42 |
| 2006/0119348 | A1* | 6/2006 | Blossfeld | F02D 41/009 324/166 |
| 2010/0214121 | A1* | 8/2010 | Puro | E21B 44/00 340/854.6 |

OTHER PUBLICATIONS

Office Action in related application CA2984741 dated Mar. 19, 2021.

* cited by examiner

APPARATUS AND METHODS FOR COUNTERBALANCING A PUMPING UNIT

BACKGROUND

Field

Embodiments of the present disclosure generally relate to apparatus and methods for counterbalancing a pumping unit.

Description of the Related Art

In oil and gas industry, pumping units are used to mechanically lift liquid out of a wellbore to produce hydrocarbons from formation. Reciprocal pumping units, also known as conventional pumping units, are widely used.

A reciprocal pumping unit converts a rotary motion of a motor to a vertical reciprocating motion to drive a downhole pump connected to the surface pumping unit via a sucker rod string. The motor, through a gear box, rotates a pair of cranks. Rotation of the cranks raises and lowers one end of a walking beam. A curved metal box, known as a horse head, is attached to the other end of the walking beam. The horse head is attached to a rod string, that is suspended in the wellbore. The up and down movement of the horse head raises and lowers the rod string. The cranks are usually installed with counter balance weights to assist the motor in lifting the polished rod string. The amount of counterweights is selected to counterbalance the loads on the horsehead to minimize energy used to produce hydrocarbons from the wellbore and to extend lifetime of pumping unit components.

Currently, counterbalance weights are selected according to a rough calculation based on the size of the pumping unit and the forces from the polished rod string. After selecting the counterbalance weights, operators typically let the pumping unit run for a short time while monitoring the current supplied to the motor to decide if adjustment to the counterbalance weight is needed. For example, if the motor current in one direction, e.g. upstroke, is greater than in the other direction, e.g. downstroke, then the pumping unit is not properly counterbalanced. The operator may move the counterbalance weights to a new position on the cranks to counterbalance the pumping unit.

However, monitoring motor current may become a safety hazard because high voltage wires are exposed during the process and it would be relatively easy for operators to inadvertently touch the wrong cables thereby creating a short circuit.

Therefore, there is a need for apparatus and methods to improve counterbalancing of a pumping unit.

SUMMARY

Embodiments of the present disclosure generally relate to apparatus and methods for counterbalancing a pumping unit.

One embodiment of the present disclosure provides a method for operation a pumping unit. The method includes measuring an orientation and one or more parameters of the pumping unit while running the pumping unit, and determining an imbalance of the pumping unit according to the measured orientation and one or more parameters.

Another embodiment of the present disclosure provides a counterweight balancing assembly for a pumping unit. The counterweight balancing assembly includes a sensor assembly attachable to the pumping unit. The sensor assembly comprises a first sensor positioned to detect an orientation of a counterbalance weight of the pumping unit while the pumping unit is running, and a control board capable of establishing a wired or a wireless communication.

Another embodiment of the present disclosure provides a pumping unit having a counterweight balancing assembly.

BRIEF DESCRIPTION OF THE DRAWINGS

So that the manner in which the above recited features of the present disclosure can be understood in detail, a more particular description of the various aspects, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

Figure 1A:
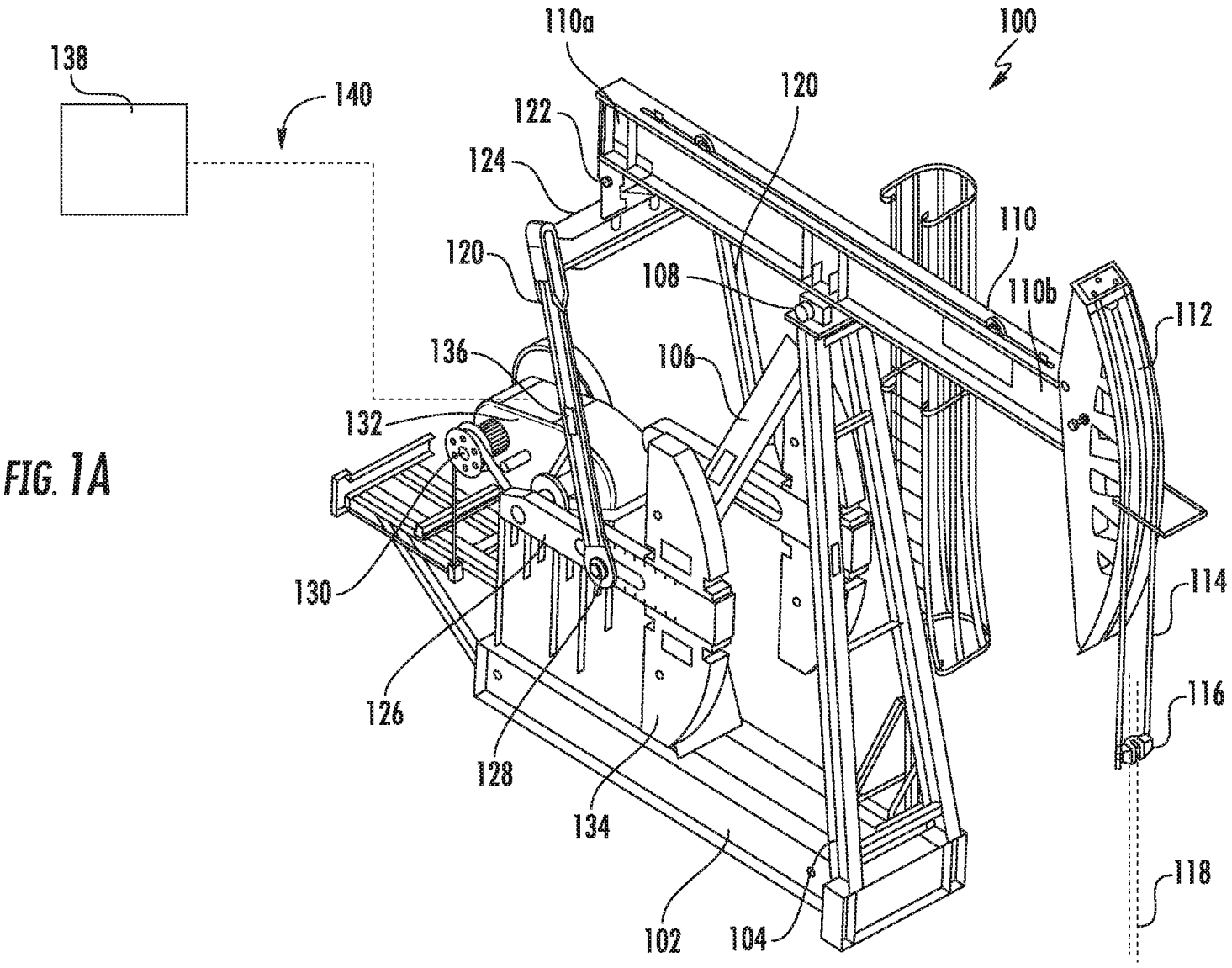
FIG. 1A is a schematic perspective view of a pumping unit having a counterweight balancing assembly.

To facilitate understanding, identical reference numerals have been used, where possible, to designate identical elements that are common to the figures. It is contemplated that elements disclosed in one embodiment may be beneficially utilized on other embodiments without specific recitation. The drawings referred to here should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

In the following description, numerous specific details are set forth to provide a more thorough understanding of the present disclosure. However, it will be apparent to one of skill in the art that the present disclosure may be practiced without one or more of these specific details. In other instances, well-known features have not been described in order to avoid obscuring the present disclosure.

FIG. 1A is a schematic perspective view of a pumping unit 100 according to one embodiment of the present disclosure.

The pumping unit 100 includes a frame 102 to be installed on a pumping unit base. The pumping unit 100 may include one or more front post 104 and one or more back post 106. A first end of the front post 104 and a first end of the back post 106 are attached to the frame 102. A second end of the front post 104 and the second end of the pack post 106 are joined together forming an A-frame to support a walking beam 110. The walking beam 110 is pivotably connected to the front post 104 and the back post 106 by a walking beam bearing assembly 108.

A pitman arm 120 is coupled to one end 110*a* of the walking beam 110 by a tail or equalizer bearing assembly 122. In one embodiment, the pumping unit 100 may include two pitman arms 120 joined by an equalizer beam 124. The equalizer beam 124 is connected to the walking beam 110 by the bearing assembly 122. Each pitman arm 120 is pivotably connected to a crank 126 by a crank pin assembly 128, also called a wrist pin. The crank 126 may be rotated by a motor 130. In one embodiment, a gear box 132 may be connected between the motor 130 and the crank 126. One or more counterweight blocks 134 may be attached to the crank 126.

A horse head 112 is attached to another end 110*b* of the walking beam 110. A wireline 114 is attached to the horse head 112. The wireline 114 may include a polished rod hanger 116 configured to secure a polish rod string 118.

During operation, the motor 130 rotates the crank 126. Rotation of the crank 126 causes the end 110*a* of the walking beam 110 to move up and down through the pitman arm 120. Up and down movement of the end 110*a* causes the walking beam 110 to pivot about the walking beam bearing assembly 108 resulting in downstroke and upstroke of the horse head 112.

During an upstroke, the motor 130 aided by the counterbalance weight 134 overcomes weight and load on the horse head 112 and pulls the polished rod string 118 up from the wellbore. During a downstroke, the motor 130 aided by the weight and load on the horsehead 112 rotates the crank 126 to raise the counterbalance weight 134.

Counterbalance weight 134 may be selected according to the weight and load of the polished rod string 118. The load of the polished rod string 118 may be related to the force for lifting the polished rod string and the weight of the fluid above the downhole pump in the wellbore.

In one embodiment, the counterbalance weight 134 may be selected so that one or more components of the pumping unit 100 have substantially symmetrical acceleration and/or velocity during upstrokes and downstrokes. The component may be any moving part of the pumping unit 100, such as the pitman arm 126, the wrist pin assembly 128, the crank 126, the equalizer beam 122, the walking beam 110, and the horse head 112.

In one embodiment, the pumping unit 100 may include a counterweight a counterweight balancing assembly 140 used to balancing the pumping unit 100. The counterweight balancing assembly 140 may include a sensor assembly 136 and a controller 138. The sensor assembly 136 attached to a moving component of the pumping unit 100 to measure one or more parameter that is related to an imbalance between the loads from the polished rod string 118 and the counterbalance weights 134. The one or more parameter may include at least one of velocity and acceleration of the moving component. In one embodiment, the one or more parameter may include orientation of the counterbalance weight 134.

In one embodiment, the sensor assembly 136 may be attached to the pitman arm 126 to measure at least one of velocity and acceleration of the pitman arm 126 and the orientation the counterbalance weight 134. In one embodiment, the sensor assembly 136 may be attached to the pitman arm 126 near the wrist pin assembly 128 so that the sensor assembly 136 may be used to measure velocity and/or acceleration of the counterbalance weight 134.

Alternatively, the sensor assembly 136 may be attached to the walking beam 110 or either end of horsehead 112 to measure the acceleration and/or velocity of the walking beam 110 or the horsehead respectively.

In one embodiment, the sensor assembly 136 may send measurement to the controller 138 via wired or wireless communication. The controller 138 may include computer programs for analyzing measurements from the sensor assembly 138. The controller 138 may include programs for rendering a graphic representation of the pumping unit 100 to illustrate any imbalance of the counterbalance weight based on the measurement from the sensor assembly 134. The controller 138 may include programs providing balancing solutions, for example, providing adjustment to balance the pumping unit 100.

Figure 1B:
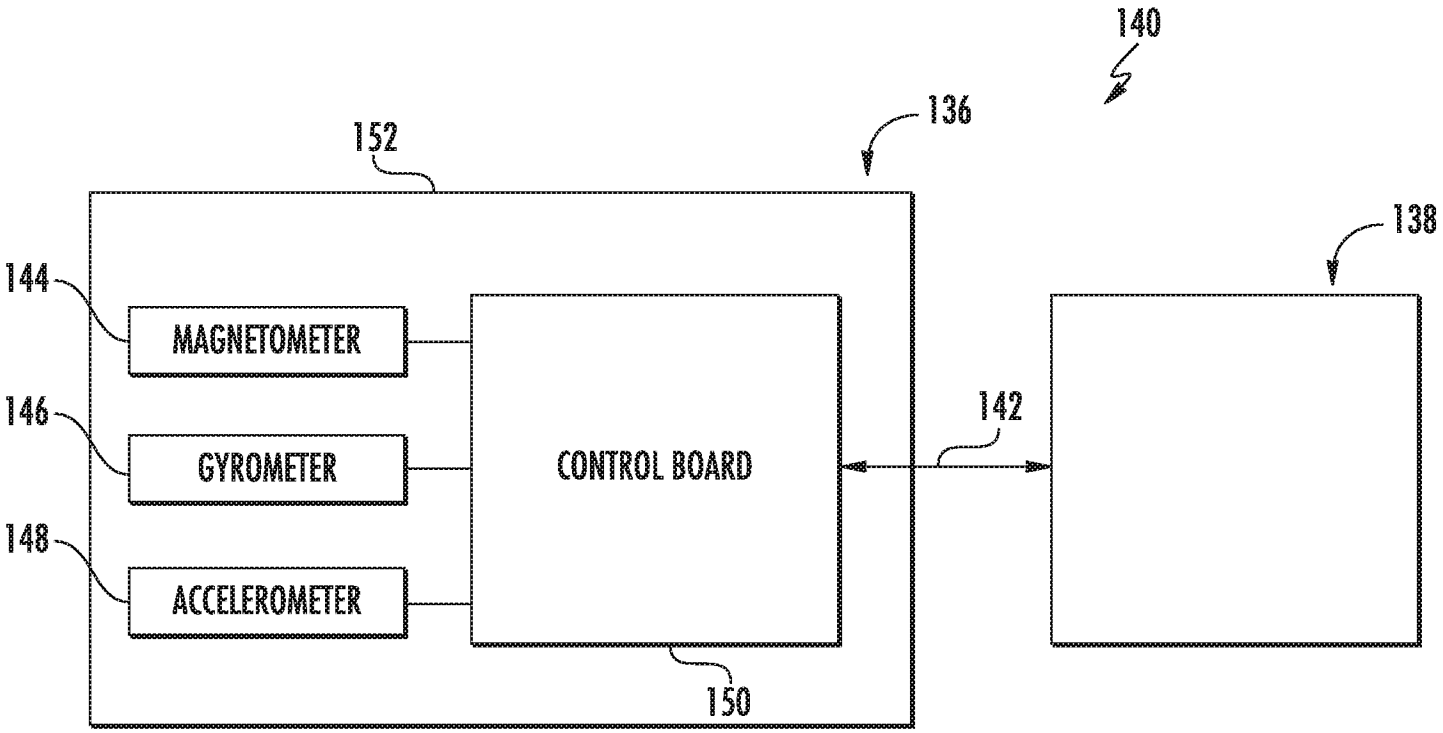
FIG. 1B is a schematic diagram of the counterweight balancing assembly of FIG. 1A.

FIG. 1B is a schematic diagram of the counterweight balancing assembly 140 according to one embodiment of the present disclosure. The sensor assembly 136 may include an orientation sensor 144 for measuring orientation, such as the orientation of the counterbalance weight 134. In one embodiment, the orientation sensor 144 may be a magnetometer which is useful to describe the orientation of the element it is attached to in the earth's magnetic field. Furthermore, it could provide information on the placement or position of the counterbalance weight in relationship to the element to which it is attached.

The sensor assembly 136 may include a velocity sensor 146. In one embodiment, the velocity sensor 146 may be a gyrometer. In one embodiment, the velocity sensor 146 may be a 3-axis gyrometer. Alternatively, the velocity sensor 146 may be any suitable sensor for measuring velocity.

The sensor assembly 136 may include an acceleration sensor 148. In one embodiment, the acceleration sensor 148 may be an accelerometer. In one embodiment, the acceleration sensor 148 may be a 3-axis accelerometer. Alternatively, the acceleration sensor 148 may be any sensors suitable for measuring acceleration.

Even though both the velocity sensor 146 and the acceleration sensor 148 are shown in FIG. 1B, the sensor assembly 136 may include only one of the velocity sensor 146 and the acceleration sensor 148. And it may also be configured to only sense the velocity or acceleration in one axis.

The sensor assembly 136 may further include a control board 150 connected to the sensors 144, 146, 148. The control board 150 may include input/output ports to connect with the sensors 144, 146, 148. The control board 150 may establish a communication 142 with the controller 138. The communication 142 may be a wired or a wireless communication. In one embodiment, the control board 140 may be a single-board computer, such as a Raspberry Pi.

In one embodiment, the sensor assembly 136 may include a housing 152. The housing 152 may be a hermetic housing that encloses the sensors 144, 146, 148 and control board 150 therein. The housing 152 may further include structures to permit secure attachment of the sensor assembly 136 to a moving component of the pumping unit 100.

In one embodiment, the sensor assembly 136 may be a low energy Bluetooth sensor unit, such as a SensorTag unit by Texas Instrument.

Even though the sensors 144, 146, 148 are shown attached at the same position on the pumping unit 100, the orientation sensor 144 and the velocity sensor 146/acceleration sensor 148 may be attached at different positions on the pumping unit 100, for example, the walking beam 110 or the horsehead 112.

The controller 138 may be a computer or a mobile device, such as a smart phone or a tablet. The controller 138 may include a display screen. The controller 138 may include computer programs or an application for analyzing measurements from the sensor assembly 136, detecting a balance condition, such as any imbalance, in the pumping unit 100, and/or providing a solution to balance the pumping unit 100. In one embodiment, the controller 138 may include a program for displaying a graphical representation of the motion of the pumping unit 100 to indicate the adjustment of the counterbalance weight 134.

Figure 2A:
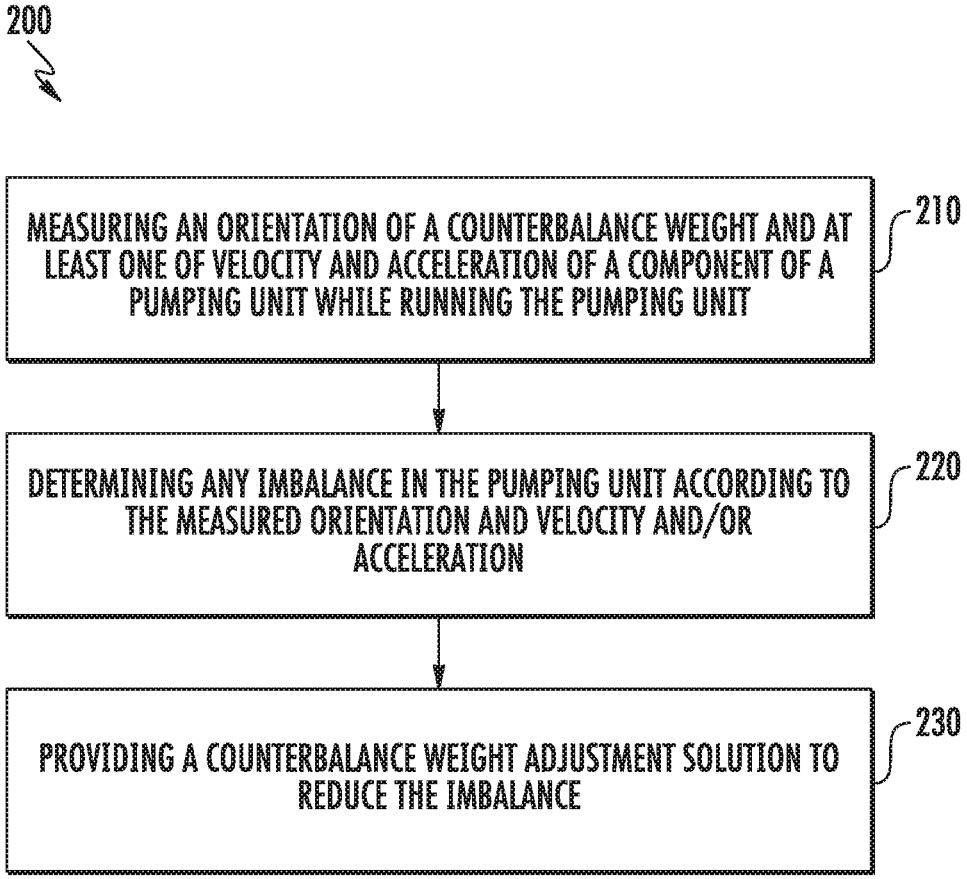
FIG. 2A is a flow chart of a method for balancing a pumping unit according to one embodiment of the present disclosure.

FIG. 2A is a flow chart of a method 200 for balancing a pumping unit according to one embodiment of the present disclosure. The method 200 may be used to balancing a pumping unit, such as the pumping unit 100, using a counterweight balancing unit, such as the counterweight balancing unit 140.

In box 210, an orientation of the counterbalance weight of a pumping unit and at least one of velocity and acceleration of a component of the pumping unit are measured while running the pumping unit. The measurement may be performed for a short period, for example, for several revolutions of the counterbalance weight.

In one embodiment, an orientation sensor may be attached to the pumping unit at a position to measure the position of the counterbalance weight as the pumping unit moves. In one embodiment the orientation sensor may be attached to the pitman arm of the pumping unit. Alternatively, the orientation sensor may be attached at any position that moves relatively to the counterbalance weight while the pumping unit is running. In one embodiment, orientation of the counterbalance weight may be measured along three axes.

In one embodiment, a velocity sensor and/or an acceleration sensor may be attached to a moving component of the pumping unit to measure velocity and/or acceleration of the component. The moving component may be the pitman arm. In one embodiment, the velocity and/or acceleration sensor may be attached to the pitman arm near the crank pin assembly. In one embodiment, velocity/acceleration of the moving component may be measured along three axes.

In one embodiment, the orientation sensor and the velocity sensor and/or the acceleration sensor may be included in a sensor assembly and attached to the pumping unit at the same position.

In box 220, the measured orientation and the measured velocity and/or acceleration may be used to determine a balance condition, such as if there is any imbalance in the pumping unit. The imbalance may be determined in a controller connected to the sensor assembly, such as the controller 138 of FIG. 1A. The measured orientation may be used to determine upstroke and downstroke of the pumping unit. The measured orientation may be correlated with the measured velocity and/or acceleration to determine any counterweight imbalance in the pumping unit. In one embodiment, the degree of imbalance may be determined by the degree of asymmetry in the velocity and/or acceleration during upstrokes and the velocity and/or acceleration during downstrokes. For example, the counterweight imbalance may be quantified by the difference in velocity and/or acceleration between upstroke and downstroke.

In one embodiment, a threshold value of difference in velocity and/or acceleration between upstroke and downstroke may be used to determine if the counterweight imbalance needs correction. When the imbalance exceeds the threshold value, the counterweight may be adjusted to reduce the imbalance.

In box 230, a solution for counterweight adjustment may be provided to reduce the determined counterweight imbalance. The solution may be provided by a controller connected to the sensor assembly, such as the controller 138 of the FIG. 1A. The solution may be based on the calculation from the determined imbalance and parameters of the pumping unit. The solution may be calculated from principals of dynamics. In one embodiment, the solution may be in form of placement adjustment and/or weight adjustment of the counterweight. In one embodiment, the solution may be rendered in a program in the controller. In one embodiment, the solution may be presented in a graphical representation of the pumping unit showing the motion of placement and/or weight correction.

Adjustment to the counterbalance weight may be made according to the solution in box 230. In one embodiment, the method 200 and adjustment may be repeated until imbalance determined in box 220 is within a threshold value.

Figure 2B:
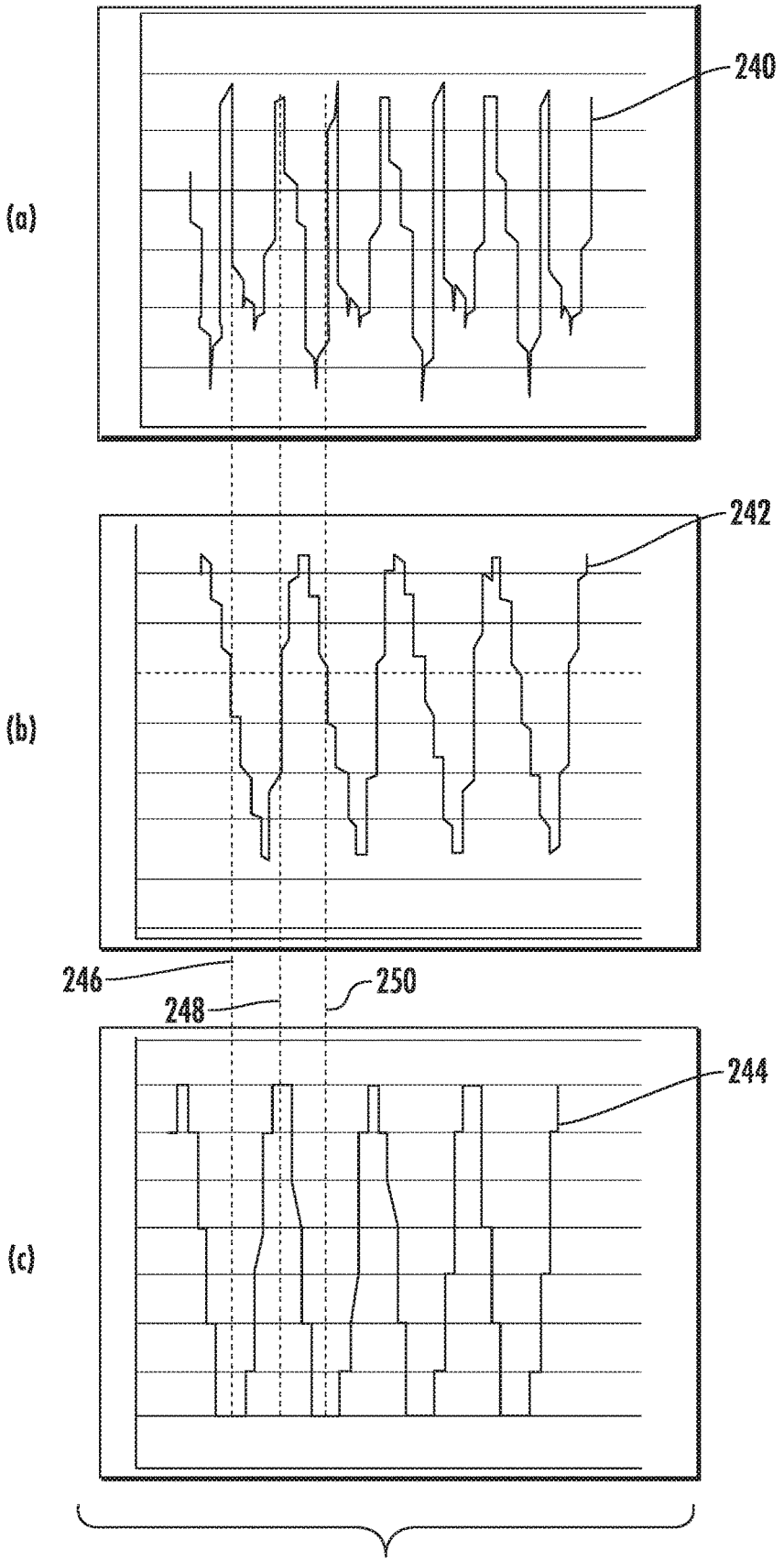
FIG. 2B is an exemplary chart of sensor measurements prior to counterweight adjustment according to the method of FIG. 2A.

FIG. 2B is an exemplary chart of sensor measurements according to the method of FIG. 2A. FIG. 2B includes measurements of a magnetometer, a gyrometer, and an accelerometer attached to the pitman arm near the wrist pin assembly. Curve 240 reflects measurements of the magnetometer. Curve 240 reflects the additional mass of the counterbalance weight as it nears the sensor. Combining this measurement with the velocity and acceleration measurements could be used to infer whether the weight is in the correct position. The curve 240 may be used to derive positions of the counterbalance weight during the measurement period. Curve 242 reflects measurements of the gyrometer. Curve 242 relates to velocity of the counterbalance weight during several revolutions. Curve 244 reflects measurements of the accelerometer. Curve 244 relates to the acceleration of the counterbalance weight during several revolutions.

The measurements of the magnetometer, gyrometer, and accelerometer may be made in synchronization and correlated to analyze dynamics of the counterbalance weight. Dash lines 246, 248, 250 mark the correlation between the measurements of the magnetometer, gyrometer, and accelerometer. The measurements between dash lines 246, 248 are measurements of a downstroke. The measurements between dash lines 248, 250 are measurements of an upstroke. The curve 242 indicates that the maximum velocity during the downstroke is much larger than the maximum velocity during the upstroke. The acceleration shown in the curve 244 reflects of combinations of all forces applied to the counterbalance weight at different positions during a revolution, thus providing a basis for an adjustment solution to reduce the differences between upstroke and downstroke. Measurements of curves 240, 242, 244 may be used to generate a graphical representation the motion of the counterbalance weight.

Figure 2C:
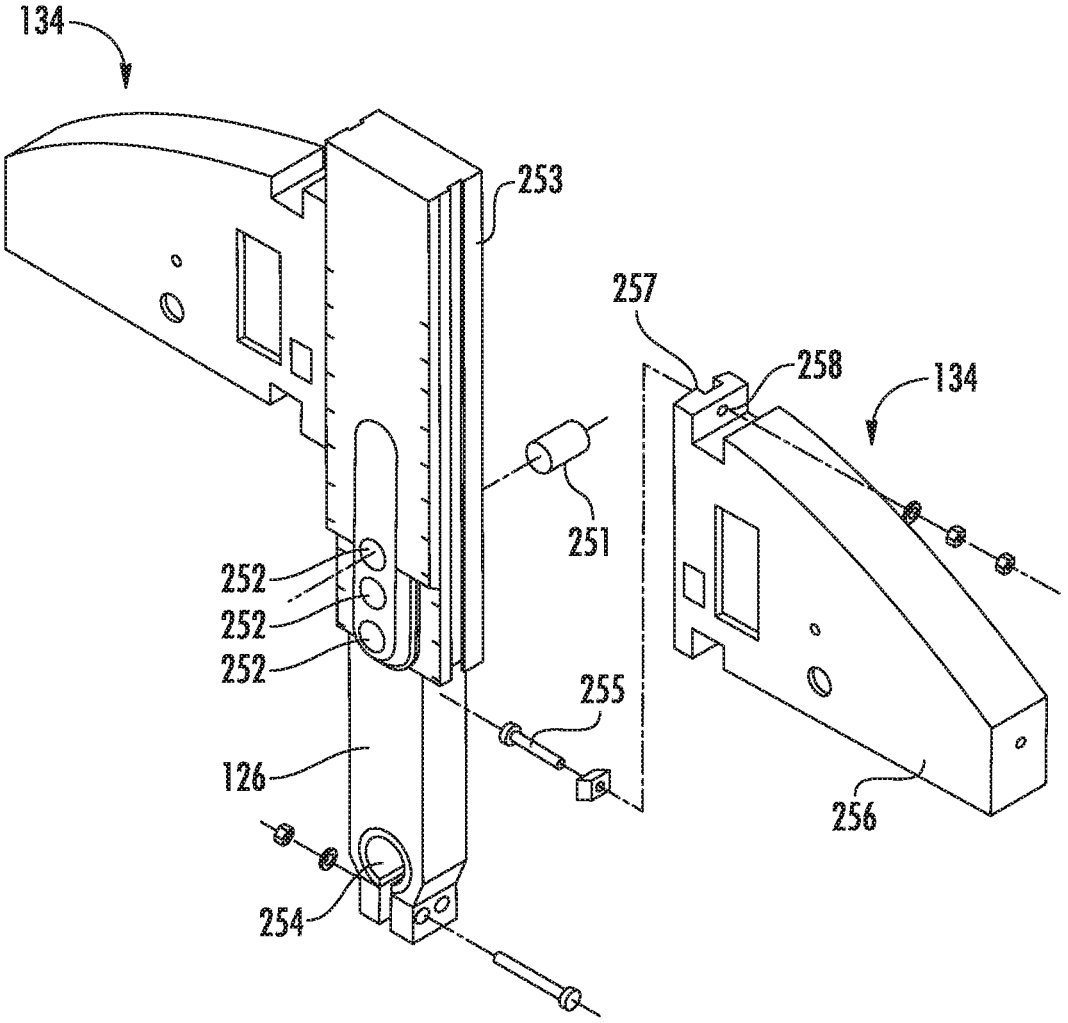
FIG. 2C is a schematic perspective view of a crank with adjustable counterbalance weight for a pumping unit.

FIG. 2C is a schematic perspective view of the crank 126 with adjustable counterbalance weight 134 according to one embodiment of the present disclosure. The crank 126 may include a key hole opening 254 for coupling to an output axis of a motor and a gearbox, so that the crank 126 rotates about the center of the key hole opening 254. The crank 126 may include one or more through holes 252 at different distances from the key hole opening 254. Each through hole 252 may receive an insert 251 for coupling to the pitman arm 120. The pitman arm 120 may be coupled connect to the crank 126 at different through holes 252.

The crank 126 may include one or two rails 253 formed along sides of the crank 126 for receiving one or two counterbalance weight 134. Each counterbalance weight 134 may have groove 257 corresponding to the rail 253 to allow the counterbalance weight 134 to slide along the crank 126.

The counterbalance weight 134 may be secured to the crank 126 at different locations along the rail 153 using an insert 255.

Counterweight balance may be adjusted by sliding one or both counterbalance weight 134 along the rail 253, switching one or both counterbalance weight 134 to a heavier or a lighter weight, removing or adding a counterbalance weight, or switching connection to the pitman arm 120 from a different through hole 152. The solution provided in box 230 of the method 200 may be any one or any combination of the adjustments.

Figure 2D:
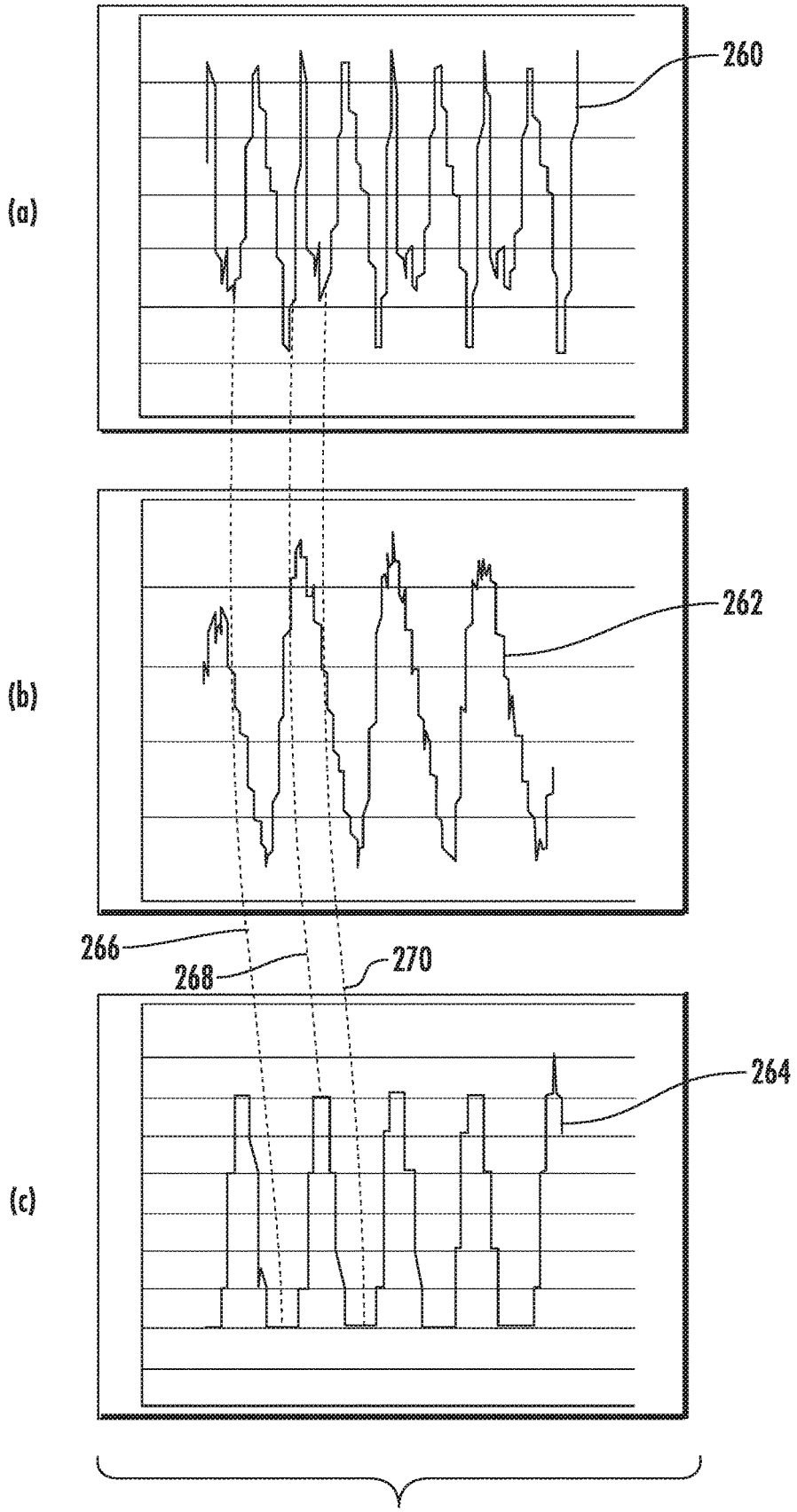
FIG. 2D is an exemplary chart of sensor measurements after counterweight adjustment according to the method of FIG. 2A.

FIG. 2D is an exemplary chart of sensor measurements. FIG. 2D includes measurements of the magnetometer, gyrometer, and accelerometer after an adjustment according to solution provided by box 230. Curve 260 reflects measurements of the magnetometer. Curve 262 reflects measurements of the gyrometer. Curve 264 reflects measurements of the accelerometer. Dash lines 266, 268, 260 mark the correlation between the measurements of the magnetometer, gyrometer, and accelerometer. The measurements between dash lines 266, 268 are measurements of a downstroke. The measurements between dash lines 268, 260 are measurements of an upstroke. The difference between the maximum velocities during downstroke and upstroke in curve 262 is smaller than the difference between the maximum velocities during downstroke and upstroke in curve 242, showing reduction in imbalance.

Figure 3A:
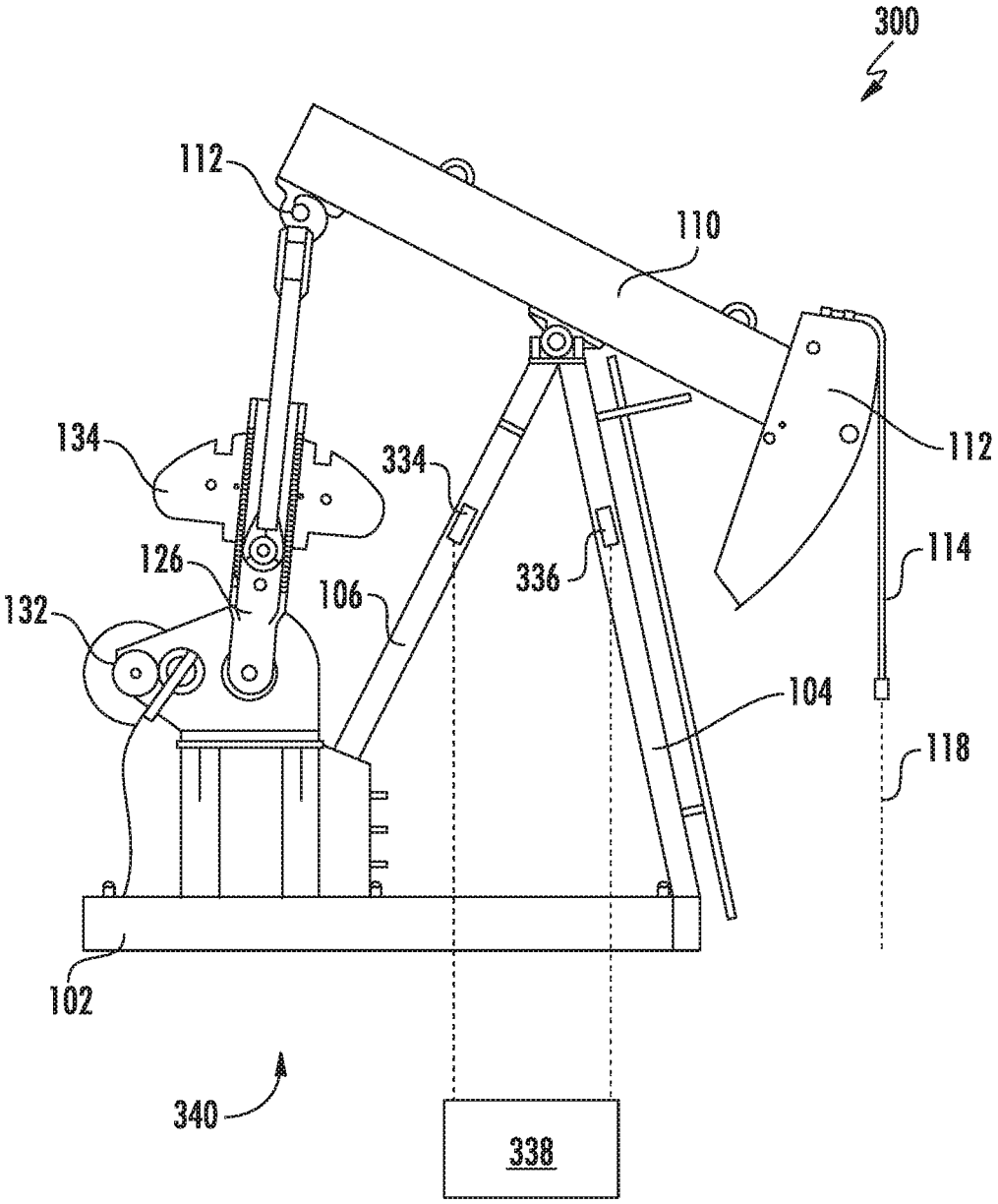
FIG. 3A is a schematic perspective view of a pumping unit having a counterweight balancing assembly.

FIG. 3A is a schematic perspective view of a pumping unit 300. The pumping unit 300 is similar to the pumping unit 100 except that the pumping unit 300 includes a counterweight balancing assembly 340 attached to one or more stationary components of the pumping unit 300. In one embodiment, the counterweight balancing assembly 340 may include one or more sensors configured to measure strains on the corresponding component.

The counterweight sensing assembly 340 includes a first sensor assembly 334 attached to a first stationary component, a second sensor assembly 336 attached to a second stationary component, and a controller 338 in communication with the first sensor assembly 334 and the second sensor assembly 336. The sensor assemblies 334, 336 may be used to measure strains sustained on the first stationary component and second stationary component respectively while the pumping unit 300 is running. The measured strains on the first and second stationary components may be compared to determine the balance condition of the pumping unit 300. In one embodiment the strain is used to determine an imbalance. The controller 338 is then used to determine the adjustments to the position of the counterbalance weights and/or the weight of the counterbalance weights.

In one embodiment, the first sensor assembly 334 may be attached to the back post 106 and the second sensor assembly 336 may be attached to the front post 104. The first sensor assembly 334 may be positioned to measure the strain on the back post 106 while the pumping unit 300 is running. The second sensor assembly 336 may be positioned to measure the strain on the front post 104 while the pumping unit 300 is running. The measured strains in the front post 104 and the back post 106 may be compared to determine balance condition of the pumping unit 300.

Alternatively, the sensor assemblies 334, 336 may be attached to other components of the pumping unit 300. For example, the sensor assemblies 334, 336 may be attached to walls of the gear box 132 to measure the strain at the gear box 132. Gears in the gear box 132 are axially grinded, thus transferring loads to surrounding structures, such walls of the gear box 132. Strain or deflection sustained by walls of the gear box 132 may reflect loads transferred from through the gear box 132.

The sensor assemblies 334, 336 may send measurement to the controller 338 via a wired or wireless communication. The controller 338 may include computer programs for analyzing measurements from the first and sensor assemblies 334, 336. The controller 338 may correlate measurements from the first and second sensor assemblies 334, 336. The controller 338 may generate rotational acceleration and/or velocity of the counterbalance weight 134 from the measured strains by the first and sensor assemblies 334, 336. The controller 338 may include programs for rendering a graphic representation of the pumping unit 300 to illustrate any imbalance of the counterbalance weight based on the measurements from the sensor assemblies 334, 336. The controller 338 may include programs providing balancing solutions, for example, providing adjustment to balance the pumping unit 300.

Figure 3B:
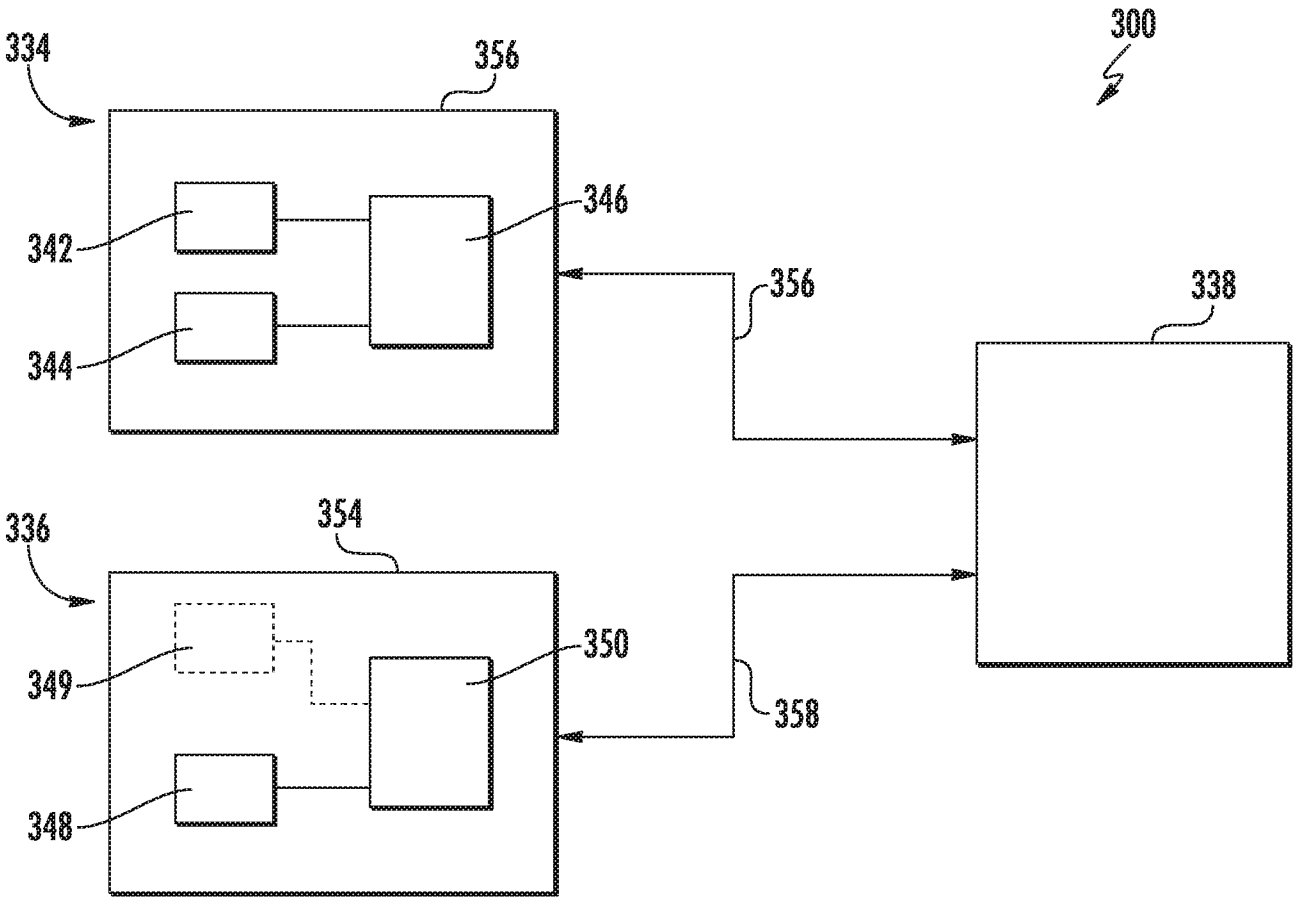
FIG. 3B is a schematic diagram of the counterweight balancing assembly of FIG. 3A.

FIG. 3B is a schematic diagram of the counterweight balancing assembly 340 according to one embodiment of the present disclosure. The sensor assembly 334 may include a strain gauge 342 configured to the measure strain at the position where the sensor assembly 334 is attached. The sensor assembly 334 may include an orientation sensor 344 for measuring orientation, such as the orientation of the counterbalance weight 334. In one embodiment, the orientation sensor 344 may be a magnetometer configured to measure strength of a magnetic field, such as a magnetic field of the counterbalance weight 134 which is made of ferrous material. In one embodiment, the orientation sensor 344 is a 3-axis magnetometer. Alternatively, the orientation sensor 344 may be any suitable sensor for measuring orientation.

The sensor assembly 334 may further include a control board 246 connected to the sensors 342, 344. The control board 346 may include input/output ports to connect with the sensors 342, 344. The control board 346 may establish a communication 256 with the controller 338. The communication 356 may be a wired or a wireless communication. In one embodiment, the control board 346 may be a single-board computer, such as a Raspberry Pi.

In one embodiment, the sensor assembly 333 may include a housing 352. The housing 352 may be a hermetic housing that encloses the sensors 342, 344 and control board 346 therein. The housing 352 may further include structures to permit secure attachment of the sensor assembly 334 to a moving component of the pumping unit 300. In one embodiment, the sensor assembly 334 may be a low energy Bluetooth sensor unit, such as a SensorTag unit by Texas Instrument.

The sensor assembly 336 may include a strain gauge 348 configured to the measure strain at the position where the sensor assembly 336 is attached. Optionally, the sensor assembly 336 may include an orientation sensor 349 for measuring orientation.

The sensor assembly 336 may further include a control board 250 connected to the sensors 348, 349. The control board 350 may include input/output ports to connect with the sensors 348, 349. The control board 350 may establish a communication 358 with the controller 338. The communication 358 may be a wired or a wireless communication. In one embodiment, the control board 350 may be a single-board computer, such as a Raspberry Pi.

In one embodiment, the sensor assembly 336 may include a housing 354. The housing 354 may be a hermetic housing that encloses the sensors 348, 349 and control board 350 therein. The housing 354 may further include structures to permit secure attachment of the sensor assembly 336 to a moving component of the pumping unit 300. In one embodiment, the sensor assembly 336 may be a low energy Bluetooth sensor unit, such as a SensorTag unit by Texas Instrument.

The controller 338 may be a computer or a mobile device, such as a smart phone or a tablet. The controller 338 may include a display screen. The controller 338 may include computer programs or an application for analyzing measurements from the sensor assemblies 334, 336, detecting any imbalance in the pumping unit 300, and/or providing a solution to balance the pumping unit 300. In one embodiment, the controller 238 may include a program for displaying a graphical representation of the motion of the pumping unit 200 to indicate the adjustment of the counterbalance weight 134.

Figure 4:
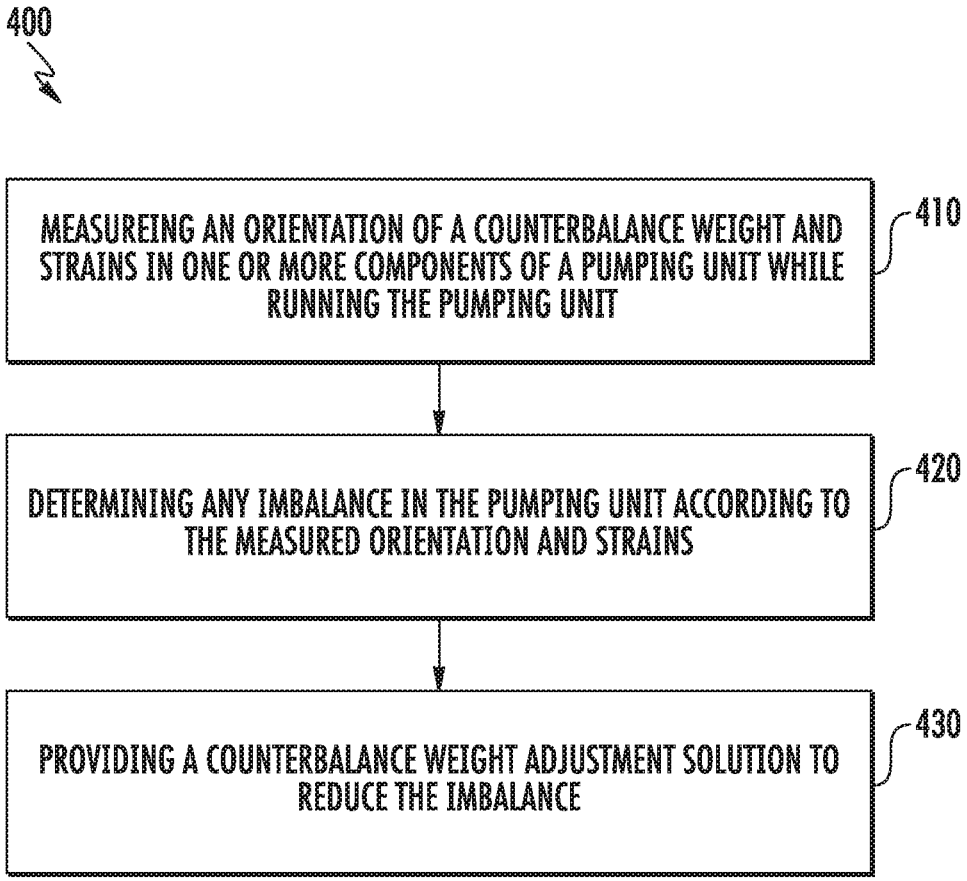
FIG. 4 is a flow chart of a method for balancing a pumping unit according to one embodiment of the present disclosure.

FIG. 4 is a flow chart of a method 400 for balancing a pumping unit according to one embodiment of the present disclosure. The method 400 may be used to balancing a pumping unit, such as the pumping unit 200, using a counterweight balancing unit, such as the counterweight balancing unit 340.

In box 410, an orientation of the counterbalance weight of a pumping unit and strains of two components of the pumping unit are measured while running the pumping unit. The measurement may be performed for a short period, for example, for several revolutions of the counterbalance weight.

In one embodiment, an orientation sensor may be attached to the pumping unit at a position to measure the position of the counterbalance weight as the pumping unit moves. In one embodiment the orientation sensor may be attached to one or both components whose strain are being measured. Alternatively, the orientation sensor may be attached at any location moving relative to the counterbalance weight while the pumping unit is running. In one embodiment, orientation of the counterbalance weight may be measured along three axes.

In one embodiment, strain gauges may be attached to two components of the pumping unit to measure strains of the two components. The two components may stationary components. In one embodiment, strain gauges may be attached to the front post and back post of the pumping unit. In one embodiment, strains of the two components may be measured along three axes.

In box 420, the measured orientation and the measured strain may be used to determine a balance condition, such as if there is any imbalance, in the pumping unit. The imbalance may be determined in a controller connected to the sensor assembly, such as the controller 338 of FIG. 3A. The measured orientation may be used to determine upstroke and downstroke of the pumping unit. The measured orientation may be correlated with the measured strains. Strains of the two components may be compared to determine any counterweight imbalance in the pumping unit. In one embodiment, the pumping unit may be operated at various speeds during measurement to amplify any imbalance in the pumping unit. In one embodiment, a threshold value of difference in velocity and/or acceleration between upstroke and downstroke may be used to determine whether the counterweight imbalance needs correction. When the imbalance exceeds the threshold value, the counterweight may be adjusted to reduce the imbalance.

In box 430, a solution for counterweight adjustment may be provided to reduce the determined counterweight imbalance. The solution may be provided by a controller connected to the sensor assembly, such as the controller 338 of the FIG. 1A. The solution may be based on the calculation from the determined imbalance and parameters of the pumping unit. The solution may be calculated from principals of dynamics. In one embodiment, the solution may be in form of placement adjustment and/or weight adjustment of the counterweight. In one embodiment, the solution may be rendered in a program in the controller. In one embodiment, the solution may be presented in a graphical representation of the pumping unit showing the motion of placement and/or weight correction.

Adjustment to the counterbalance weight may be made according to the solution in box 430. In one embodiment, the method 400 and adjustment may be repeated until imbalance determined in box 420 is within a threshold value.

In another embodiment, strain gauges attached to one or more components may be used to measure strain at the components while the pumping unit is not running and determine imbalance in the pumping unit using measured strain.

Embodiments of the present disclosure provide a method for operation a pumping unit. The method includes measuring an orientation of a component and one or more parameters of the pumping unit while running the pumping unit, and determining an imbalance of the pumping unit according to the measured orientation and one or more parameters.

In one or more embodiment, the method further comprises providing a solution to reduce the imbalance.

In one or more embodiment, measuring the orientation of a component comprises measuring an orientation of a counterbalance weight.

In one or more embodiment, measuring the orientation of the counterbalance weight comprising sensing a magnetic field of the counterbalance weight.

In one or more embodiment, measuring the one or more parameters further comprises measuring at least one of velocity and acceleration of a moving component of the pumping unit.

In one or more embodiment, the moving component is the counterbalance weight.

In one or more embodiment, the moving component is a pitman arm coupled to the counterbalance weight.

In one or more embodiment, determining the imbalance comprises correlating the measured orientation with the at least one of velocity and acceleration to determine at least one of velocity and acceleration during an upstroke and a downstroke.

In one or more embodiment, determining the imbalance further comprises comparing differences between at least one of the measured velocity and acceleration during the upstroke and at least one of the measured velocity and acceleration during the downstroke.

In one or more embodiment, measuring the one or more parameter further comprises measuring strains of one or more stationary components of the pumping unit.

In one or more embodiment, the one or more stationary components comprises a front post and a back post.

In one or more embodiment, determining the imbalance comprises correlating the measured orientation with the measured strain to derive rotational velocity and acceleration of the counterbalance weight during an upstroke and a downstroke.

In one or more embodiment, determining the imbalance further comprises comparing differences between the rotational velocity and acceleration during the upstroke and the rotational velocity and acceleration during the downstroke.

In one or more embodiment, sensing the magnetic field is performed using a magnetometer attached to the component of the pumping unit.

In one or more embodiment, generating a graphical representation of the pumping unit showing movement of the counterbalance weight to reduce the imbalance.

Embodiments of the present disclosure provide a counterweight balancing assembly for a pumping unit. The counterweight balancing assembly includes a sensor assembly attachable to the pumping unit. The sensor assembly comprises a first sensor positioned to detect an orientation of a component of the pumping unit while the pumping unit is running, and a control board capable of establishing a wired or a wireless communication.

In one or more embodiment, the sensor assembly further comprises a second sensor for measuring velocity or acceleration.

In one or more embodiment, the sensor assembly further comprises a third sensor for measuring acceleration or velocity.

In one or more embodiment, the first sensor is a magnetometer, the second sensor is a gyrometer, and the third sensor is an accelerometer.

In one or more embodiment, the sensor assembly further comprises a second sensor for measuring strain.

In one or more embodiment, the counterweight balancing assembly further comprises a third sensor for measuring strain.

In one or more embodiment, the counterweight balancing assembly further comprises a hermetic housing surrounding the sensor assembly.

In one or more embodiment, the counterweight balancing assembly further comprises a controller capable of establishing the communication with the control board.

In one or more embodiment, the controller includes a program, when operating, performing determining an imbalance in the pumping unit based on measurements from sensor assembly, and providing a counterbalance weight adjustment solution to reduce the imbalance.

In one or more embodiment, the program, when operating, further performing generating a graphical representation of the pumping unit showing the counterbalance weight adjustment solution.

In one or more embodiment, the controller is one of a computer, a mobile device, a tablet, and a smart phone.

Embodiments of the present disclosure further provide a pumping unit, comprising a counterweight balancing assembly according to any of the above embodiments.

In one or more embodiment, the counterweight balancing assembly comprises a sensor assembly attached to a moving component of the pumping unit.

In one or more embodiment, the sensor assembly is attached to a pitman arm. In one or more embodiment, the counterweight balancing assembly comprises a first sensor assembly attached to a first component, and a second sensor assembly attached to a second component.

In one or more embodiment, the first component is a front post and the second component is a back post.

While the foregoing is directed to embodiments of the present disclosure, other and further embodiments may be devised without departing from the basic scope thereof, and the scope thereof is determined by the claims that follow.

The invention claimed is:

1. A method of operating a pumping unit, the method comprising:

attaching a plurality of sensors to a pitman arm;

measuring, with the plurality of sensors, an orientation of the pitman arm with respect to the earth's magnetic field and at least one of a velocity and an acceleration of the pitman arm while running the pumping unit;

determining an imbalance of the pumping unit according to the measured orientation and at least one of the velocity and the acceleration of the pitman arm; and adjusting a counterbalance weight of the pumping unit to reduce the imbalance.

2. The method of claim 1, wherein the second sensor includes a magnetometer for measuring the orientation of the pitman arm with respect to the earth's magnetic field.

3. The method of claim 2, wherein the plurality of sensors include a gyrometer for measuring the velocity of the pitman arm.

4. The method of claim 3, wherein the plurality of sensors include an accelerometer for measuring the acceleration of the pitman arm.

5. The method of claim 1, wherein determining the imbalance comprises:

correlating the measured orientation with the at least one of velocity and acceleration to determine at least one of velocity and acceleration during an upstroke and a downstroke.

6. The method of claim 5, wherein determining the imbalance further comprises:

comparing differences between at least one of the measured velocity and acceleration during the upstroke and at least one of the measured velocity and acceleration during the downstroke.

7. A counterweight balancing assembly for a pumping unit, comprising:

a sensor assembly attachable to a pitman arm of the pumping unit, wherein the sensor assembly comprises:

a first sensor for measuring an orientation of the pitman arm with respect to the earth's magnetic field while the pumping unit is running;

a second sensor for measuring at least one of a velocity and an acceleration of the pitman arm while the pumping unit is running; and a control board connected to the first sensor and the second sensor and configured to output the detected orientation of the pitman arm with respect to the earth's magnetic field and the at least one of the velocity and acceleration of the pitman arm via a wired or a wireless communication.

8. The counterweight balancing assembly of claim 7, further comprising a controller capable of establishing the communication with the control board, wherein the controller is configured to:

receive the measured orientation of the pitman arm with respect to the earth's magnetic field and the at least one of the velocity and acceleration of the pitman arm;

determine an imbalance in the pumping unit based on the received measurements; and provide a counterbalance weight adjustment solution to reduce the imbalance.

9. The counterweight balancing assembly of claim 7, wherein the first sensor is a magnetometer for measuring the orientation of the pitman arm with respect to the earth's magnetic field.

10. A pumping unit, comprising:

a walking beam;

a counterweight block;

a pitman arm coupling the counterweight block to the walking beam; and a counterweight balancing assembly comprising:

a sensor assembly attachable to the pitman arm, wherein the sensor assembly comprises:

a first sensor for measuring an orientation of the pitman arm with respect to the earth's magnetic field while the pumping unit is running, a second sensor for measuring at least one of a velocity and an acceleration of the pitman arm while the pumping unit is running, and a control board connected to the first sensor and the second sensor and configured to output the detected orientation of the pitman arm with respect to the earth's magnetic field and the at least one of the velocity and acceleration of the pitman arm via a wired or a wireless communication; and a controller capable of establishing the communication with the control board, wherein the controller is configured to:

receive the measured orientation of the pitman arm with respect to the earth's magnetic field and the at least one of the velocity and acceleration of the pitman arm, determine an imbalance in the pumping unit based on the received measurements, and provide a counterbalance weight adjustment solution to reduce the imbalance.

11. The pumping unit of claim 10, wherein the counterweight balancing assembly further comprises a third sensor assembly attached to a first component, and a fourth sensor assembly attached to a second component.

12. The pumping unit of claim 11, wherein the first component is a front post and the second component is a back post.

13. The pumping unit of claim 10, wherein the counterweight block is attached to a crank.

14. The pumping unit of claim 13, wherein the counterweight block is slidably attached to the crank to adjust the imbalance.

15. The pumping unit of claim 13, wherein the pitman arm is configured to attach to different locations on the crank to adjust the imbalance.

16. The pumping unit of claim 10, wherein the first sensor is a magnetometer for measuring the orientation of the pitman arm with respect to the earth's magnetic field.

* * * * *